United States Patent [19]

Tallman et al.

[11] Patent Number: 4,701,123

[45] Date of Patent: Oct. 20, 1987

[54] GAS FUEL BURNER

[75] Inventors: William R. Tallman, Huntington; Robert A. Kaplan, Fort Wayne, both of Ind.

[73] Assignee: The Scott & Fetzer Company, Fort Wayne, Ind.

[21] Appl. No.: 946,304

[22] Filed: Dec. 24, 1986

[51] Int. Cl.[4] ..... F23M 9/06

[52] U.S. Cl. ..... 431/171; 431/172; 431/350; 239/461; 126/116 R

[58] Field of Search ..... 431/171, 172, 265, 285, 431/347, 350; 126/110 R, 116 R; 239/461, 498

[56] References Cited

U.S. PATENT DOCUMENTS

| | | | |
|---|---|---|---|
| 1,723,180 | 8/1929 | Kerr | 431/350 |
| 2,053,003 | 9/1936 | Koeln | 431/265 |
| 2,541,315 | 2/1951 | West | 431/172 |
| 2,822,867 | 2/1958 | Sassmanhausen | 431/172 |
| 2,980,171 | 4/1961 | Furczyk et al. . | |
| 3,022,815 | 2/1962 | Bloom et al. . | |
| 3,114,410 | 12/1963 | Schneider . | |
| 3,212,556 | 10/1965 | Johansson . | |
| 3,251,393 | 5/1966 | Beach et al. | 431/171 X |
| 3,259,170 | 7/1966 | Koehrer | 431/350 |
| 3,385,527 | 5/1968 | Drewry | 239/424 |
| 3,486,835 | 12/1969 | Grobe | 431/79 |
| 3,754,853 | 8/1973 | Braucksiek et al. | 431/285 |
| 3,940,234 | 2/1976 | Reed et al. | 431/181 X |
| 4,052,141 | 10/1977 | Dudheker et al. | 431/347 X |
| 4,111,642 | 9/1978 | Kopp | 431/347 |
| 4,125,359 | 11/1978 | Lempa | 431/175 |
| 4,134,719 | 1/1979 | Velie | 431/171 |
| 4,388,064 | 6/1983 | Kaplan et al. | 431/351 X |
| 4,484,887 | 11/1984 | Pettersson | 431/265 |
| 4,511,327 | 4/1985 | Ogino et al. | 431/347 X |
| 4,557,249 | 12/1985 | Sweedyk | 126/110 R |
| 4,651,711 | 3/1987 | Velie | 126/110 C |

FOREIGN PATENT DOCUMENTS

| | | |
|---|---|---|
| 2318355 | 10/1974 | Fed. Rep. of Germany . |
| 52-45735 | 4/1977 | Japan . |

*Primary Examiner*—Margaret A. Focarino
*Attorney, Agent, or Firm*—George Pappas

[57] ABSTRACT

A fuel burner apparatus for converting fossil fuel such as gas into heat. A cylindrical burner body is provided having an air inlet and a flame opening wherethrough flames, combustion gases and any unburned particles of fuel exit. A flame spreader apparatus is connected to the flame opening for evenly distributing the flames, combustion gases and unburned fuel particles coming out of the fuel burner. The fuel spreader apparatus includes a fuel spreader, a stem connected substantially perpendicular thereto and three leg portions connected at one end thereof to each other and at the other end thereof to the flame burner opening. The stem is connected to the meeting point of the three leg portions. A two-stage gas valve or a slow opening gas valve is provided for controlling the rate at which the fuel valve opens and allows fuel to enter the fuel burner. The fuel burner is connected to a heat exchanger which has a flue line and a blower connected to the flue line. The blower pulls non-turbulent combustion air through the fuel burner.

12 Claims, 11 Drawing Figures

GAS FUEL BURNER

BACKGROUND OF THE INVENTION

This invention relates generally to a fuel burner apparatus and heat exchanger for burning and converting fossil fuel such as gas into heat.

Burners have been known in the past wherein combustion air and fuel are introduced into a combustion chamber, ignited, and thereafter allowed to expand and travel out of the combustion chamber through a flame opening into a heat exchanger. Flame spreaders have been situated forward of the flame opening so as to distribute the flames and combustion gases thereby more evenly heating the heat exchanger into which the flames and combustion gases are entering.

Various apparatuses have been devised in the past to hold a flame spreader in front of a flame opening, however, these apparatuses are generally inadequate in holding the flame spreader sufficiently parallel to the flame opening and concentrically therewith so that an even distribution of the flames, combustion gases, and unburned fuel particles can occur. Some past apparatuses tend to deform due to the change in temperature, thereby causing an uneven distribution of the combustion gases, flames, and unspent fuel within the heat exchanger. Accordingly, this causes an inefficient overall heating system in that the heat exchanger is not evenly heated and, further, unspent fuel particles escape in streams without combusting and creating heat.

In the past, fuel has been introduced into burners or combustion chambers through the use of valves which are opened upon demand for heat. These valves are generally either open or closed. However, when these valves are opened, a sudden gush of fuel is generally allowed to travel into the burner and, because all the parts of the burner have not yet been fully heated and ignition cannot occur instantaneously, a certain amount of fuel is generally expended out of the burner into the flue pipe and then into the atmosphere. This is inefficient in that fuel is wasted without combusting and without causing heat to be delivered to the heat exchanger.

Burners of the past have included blowers for providing combustion air into the combustion chamber of the burner. In doing so, however, care has not generally been taken for providing non-turbulent air into the combustion chamber and, therefore, the burners have been generally loud and have been inefficient in causing all fuel particles to combust.

SUMMARY OF THE INVENTION

One object of the invention is to provide a flame spreader apparatus which can be inexpensively and easily manufactured and is capable of withstanding the heat created by the burner so as to provide an even distribution of combustion gases, flames, and unburned fuel particles coming out of the flame opening throughout the operation of the burner. By providing a flame spreader apparatus which provides an even distribution throughout the operation of the burner, the overall efficiency of the heating system can be increased.

It is also the object of the invention to provide a burner control apparatus capable of causing the burner, during ignition, to burn substantially all the fuel injected therein. In this way, the burner is more quickly heated during start up and more heat is delivered to the heat exchanger thereby causing the overall heating system to be more efficient.

It is further the object of the invention to provide a burner apparatus utilizing combustion air, not turbulent in nature, so that the burner will be overall quieter. Further, it is the object of the invention to provide less turbulent air so as to also provide a more even distribution of all fuel particles thereby causing less fuel particles to travel through the burner without combusting.

In accordance with the present invention, a flame spreader apparatus is provided wherein a flame spreader is connected in front of the flame opening of a burner through the use of a stem substantially perpendicular to the flame spreader and three equal length leg portions which together form a triad. The outer edge of each leg portion, furthest away from the meeting forming the triad, is connected to the circular peripheral edge of the flame opening. The stem is connected to the triad at the meeting of the three leg portions. In this fashion, the flame spreader is centered and continues to retain its position relative to the flame burner opening during operation because the leg portions are heated evenly and expand equally. Further, the expansion of the stem causes the flame spreader to extend only slightly forward whereat the distribution of the flames, combustion air, and unspent fuel particles remains substantially the same. Through the use of three equal length leg portions, the flame spreader remains substantially parallel to the flame burner opening thereby, during operation, retaining an even deflection and distribution of the flames, combustion gases, and unspent fuel, thus causing the heat exchanger to more evenly be heated and to cause any unburned fuel to more readily combust.

The objects of the present invention are also overcome through the utilization of a two-stage gas valve or a slow opening gas valve which gradually introduces the gaseous fuel into the combustion chamber of the burner during start up. Accordingly, substantially all of the fuel entering the combustion chamber is given time to combust during start up thereby causing start up to occur more quickly because the combustion chamber becomes heated more quickly. Further, a more efficient burner is provided in that uncombusted fuel is not expended through the flue line.

The objects of the invention are further overcome by locating the blower of the heat exchanger and fuel burner in the flue line so as to pull air through the air inlet of the burner. In this fashion, less turbulent combustion air is provided within the combustion chamber causing the burner to be quieter and more efficient by causing substantially all of the fuel to combust in an orderly fashion.

In one form thereof, the present invention is directed to a flame spreader apparatus for use with a burner including an opening wherethrough flames from within the burner exit. The flame spreader apparatus includes a flame spreader and a stem portion connected to the flame spreader. A plurality of leg portions are provided, each of which are adapted for connecting to the burner at one end thereof and meeting at least one other respective leg portion at the other end thereof. The stem portion is mounted to the meeting of the leg portions so that the flame spreader can distribute the flames coming out of the burner.

In one form thereof, the invention is directed to a fuel burner apparatus including a heat exchanger having a circular inlet and an outlet. A fuel burner having a cylindrical burner body with an air inlet and a flame opening is also provided. A ring member receiving therethrough and connected to the cylindrical burner body is provided and the burner body is also received within the heat exchanger circular inlet with the flame opening in the heat exchanger and the air inlet outside of the heat exchanger. The ring member is connected to the heat exchanger thereby also connecting the fuel burner to the heat exchanger. A flame spreader apparatus, including a flame spreader and a stem portion connected to the flame spreader, is provided. A plurality of leg portions, each of which are adapted for connecting to the burner body at one end thereof and meeting with at least one other respective leg portion at the other end thereof, are provided. The stem portion is mounted to the meeting of the leg portions whereby the flame spreader can distribute flames coming out of the burner flame opening. Draft inducing means connected to the fuel burner apparatus for forcing air through the fuel burner air inlet, the fuel burner heat exchanger, and through the heat exchanger outlet, is provided.

Other objects and advantages of the invention will become apparent from the following specification, taken in conjunction with the accompanying drawings.

BRIEF DESCRIPTION OF THE DRAWINGS

Corresponding reference characters indicate corresponding parts throughout the several views of the drawings.

Figure 1:
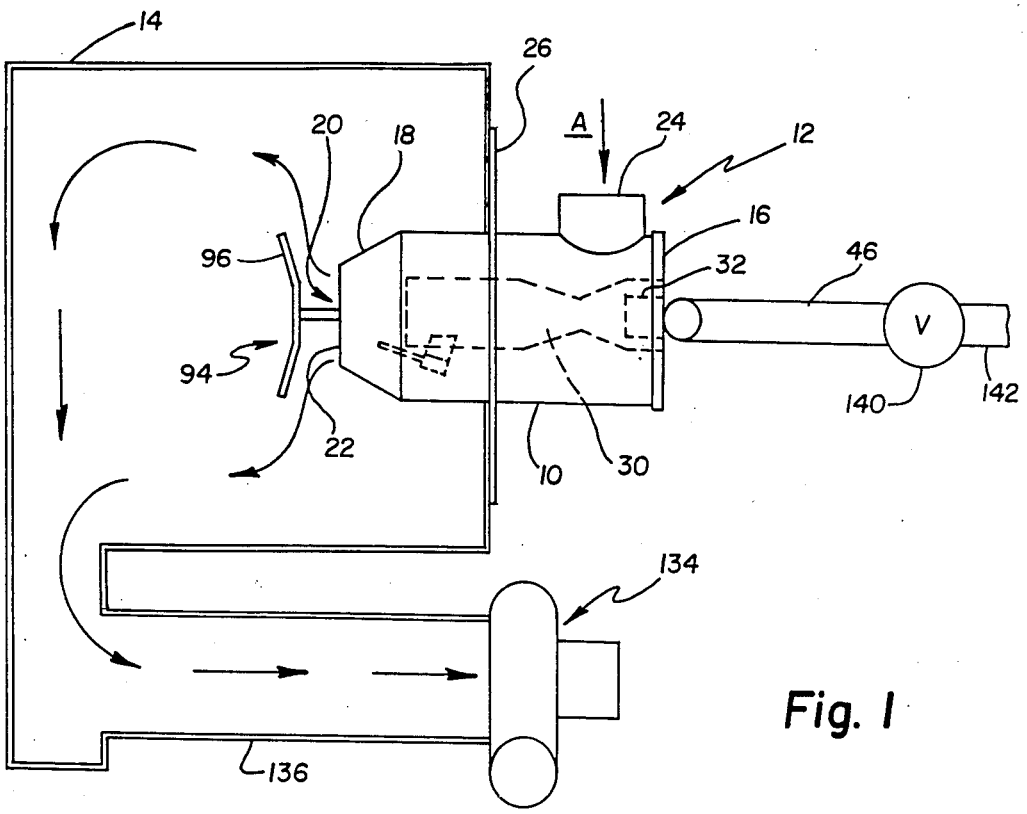
FIG. 1 is a sectional diagrammatic view of one embodiment of the fuel burner apparatus according to the present invention.

The exemplifications set out herein illustrate preferred embodiments of the invention, in one form thereof, and such exemplifications are not to be construed as limiting the scope of the disclosure or the scope of the invention in any manner.

DESCRIPTION OF A SPECIFIC EMBODIMENT

As shown in the drawings, the present invention relates to a fuel burner apparatus for burning fossil fuels such as gas. More specifically, a fuel burner generally designated as 12 burns fuel therein throwing the flames into heat exchanger 14 whereby homes and other buildings may be heated. Burner 12 includes cylindrical burner body 10 having a base 16 and a frusto-conical portion opposite the base end of cylindrical burner body 10. Frustoconical portion 18 includes burner flame opening 20 defined by circular peripheral edge 22. Burner 12 has an air inlet 24 situated substantially perpendicular to cylindrical burner body 10.

Figure 2:
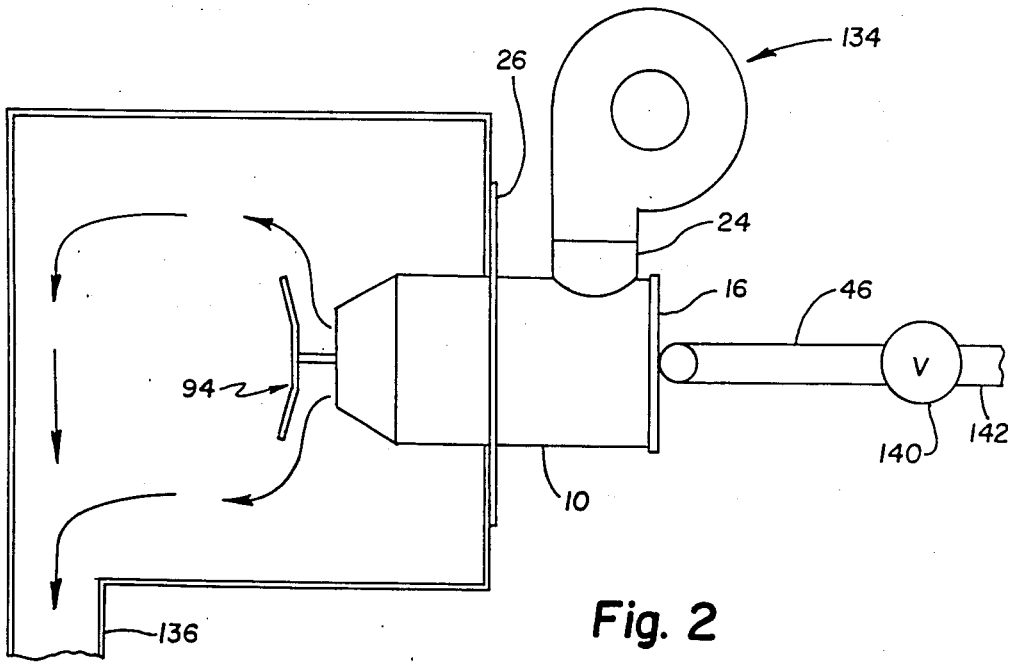
FIG. 2 is a sectional diagrammatic view of another embodiment of the fuel burner apparatus shown in FIG. 1.
Figure 3:
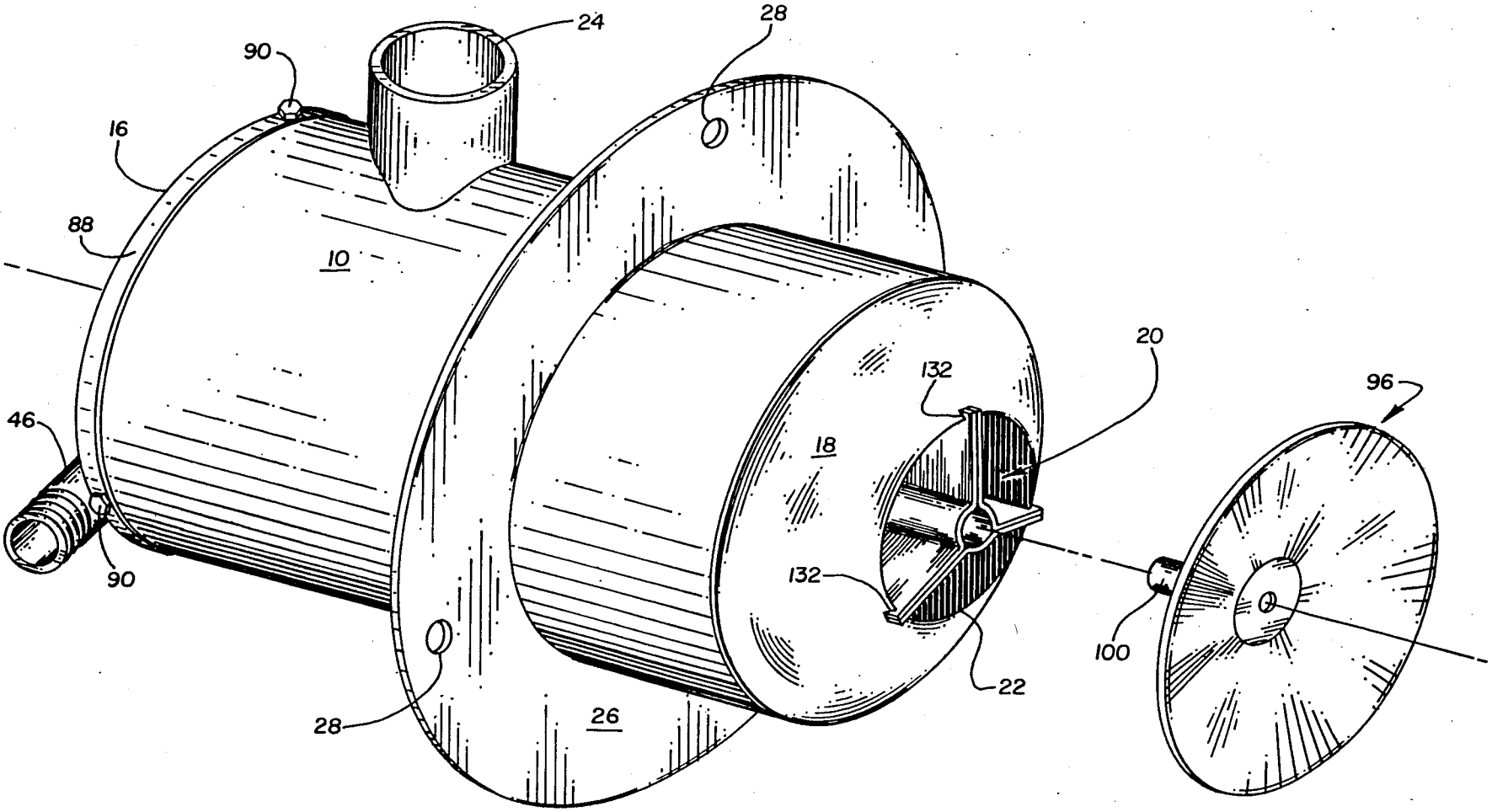
FIG. 3 a is perspective exploded view of the fuel burner apparatus shown in FIG. 1 showing the flame spreader and stem out of their assembled positions.

As shown in FIG. 3, flat ring member 26 receives therethrough and is connected to cylindrical burner body 10. Flat ring member 26 is situated substantially perpendicular to cylindrical burner body 10 and parallel to base 16. Further, as shown in FIGS. 1 and 2, flat ring member 26 is connected to heat exchanger 14 such that air inlet 24 is outside of heat exchanger 14 and burner flame opening 20 is within heat exchanger 14. Flat ring member 26 is connected to cylindrical burner body 10 by welding or other suitable means. Flat ring member 26 is also connected to heat exchanger 14 by welding or by screws adapted to be received through screw receiving holes 28 and threadably received on the side of heat exchanger 14.

As shown in FIG. 1, in dotted lines, venturi tube 30 is situated substantially concentrically within cylindrical burner body 10. Venturi tube 30 is connected to base 16 and is held in position thereby. Venturi tube 30 is connected to base 16 by puddle welding or other suitable means. As shown in FIGS. 4–7, venturi tube 30 has two air inlets 32 located near base 16. Further, venturi tube 30 includes a constriction 34 and a flame opening 36. Surrounding venturi flame opening 36 there is a corrugated portion 40. The overall structure of venturi tube 30 is supported through the use of supporting fins 38 which are integral therewith.

Figure 6:
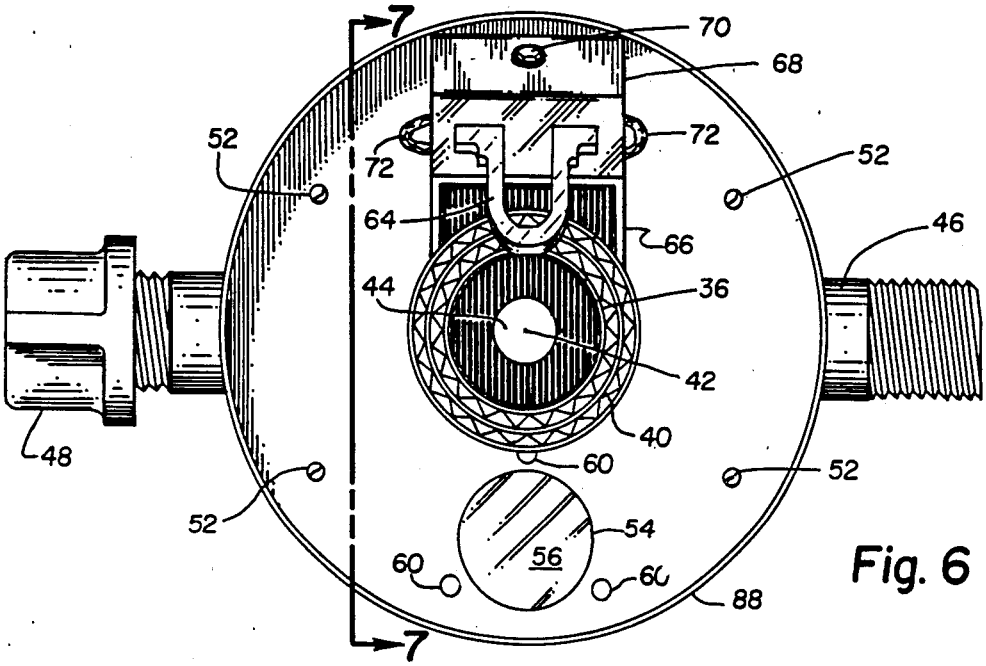
FIG. 6 is a top plan view of the venturi tube, base, and fuel pipe shown in FIG. 4 taken along line 6—6.

Fuel, such as gas, is received within venturi tube 30 near base 16 through fuel injecting orifice 42 situated concentrically within coupling 44. Fuel injecting orifice coupling 44 is threadably connected to fuel pipe 46 substantially perpendicular thereto so as to deliver fuel from within fuel pipe 46 through fuel injecting orifice 42 and into venturi tube 30. As shown in FIG. 6, fuel pipe 46, at one end thereof, is capped through the use of fuel pipe cap 48 and, at the other end thereof, is adapted for connecting to a fuel supply.

Figure 4:
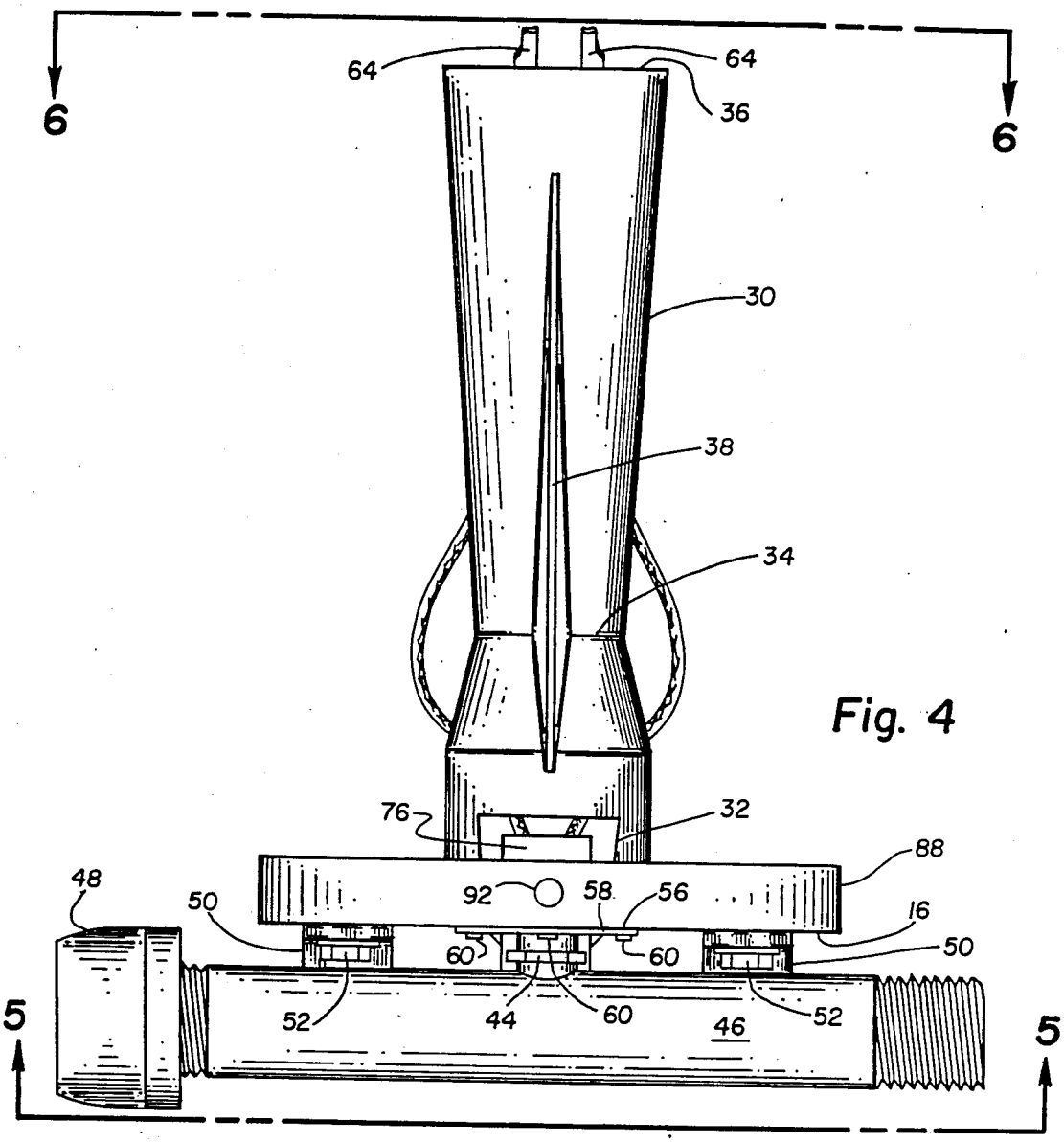
FIG. 4 is a side elevation view showing the base, venturi tube, and fuel line of the fuel burner shown in FIG. 1.
Figure 5:
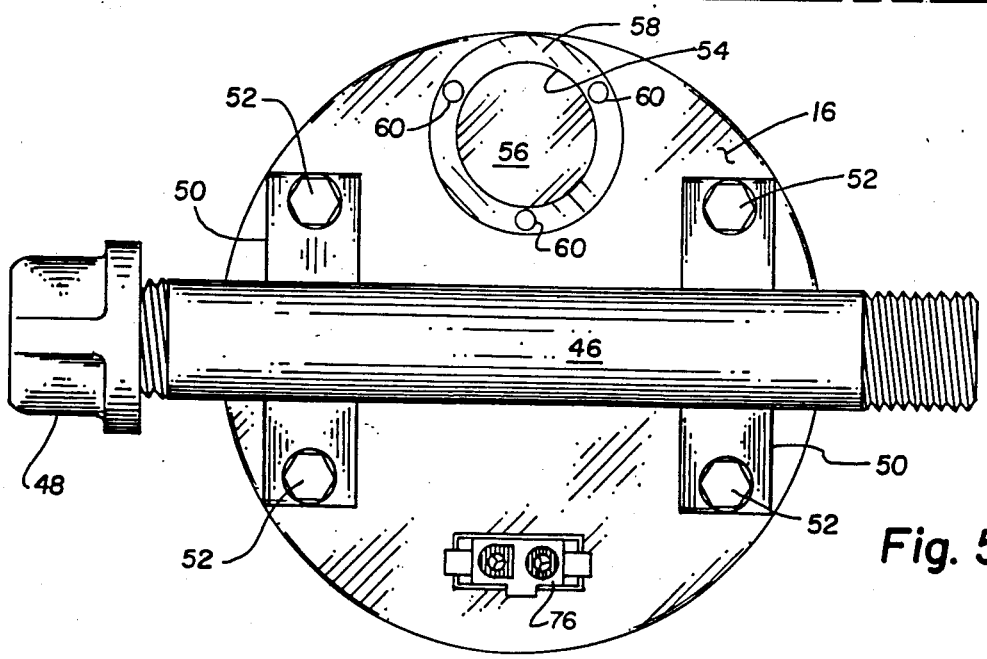
FIG. 5 is a bottom plan view of the fuel burner shown in FIG. 1 taken along line 5—5 of FIG. 4.
Figure 7:
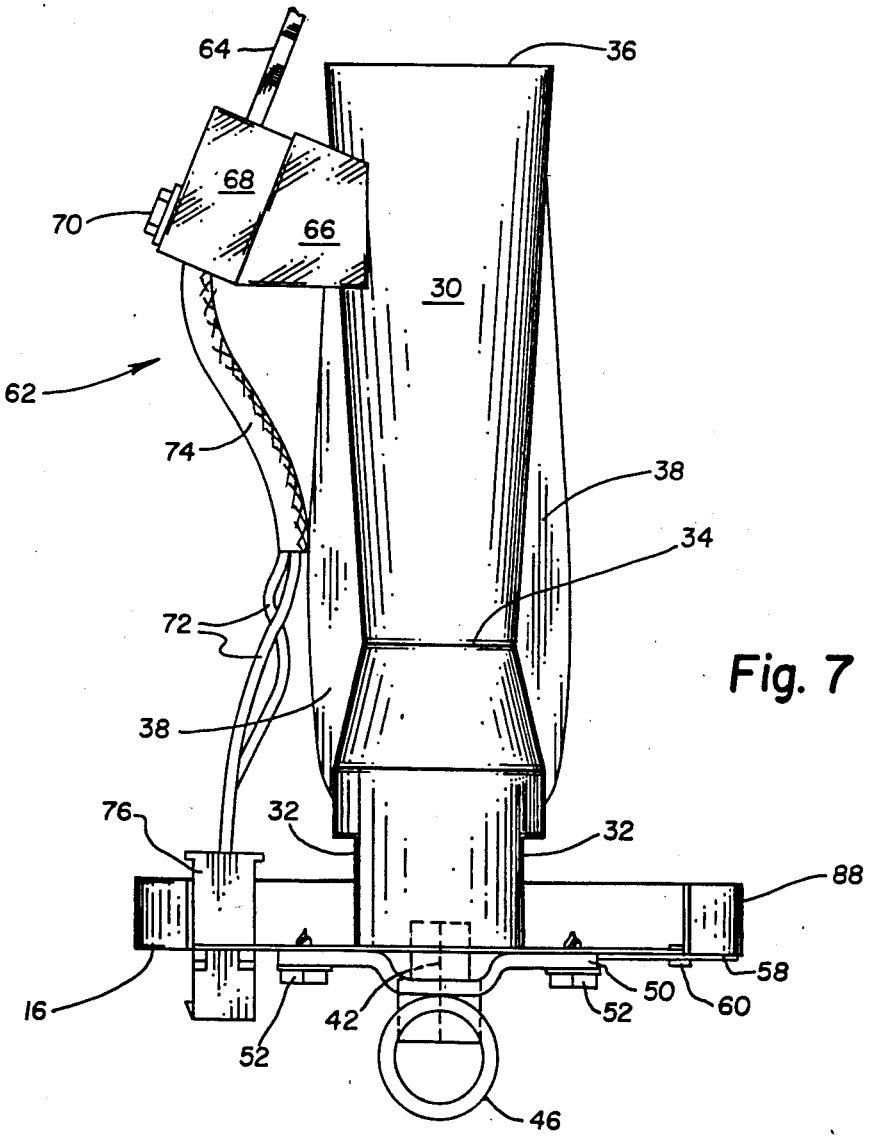
FIG. 7 is a side sectional view of the venturi tube, base and fuel pipe shown in FIG. 6 taken along line 7—7.

As shown in FIGS. 4, 5, and 7, fuel pipe 46 is connected to base 16 with brackets 50. Brackets 50 are welded near the center thereof onto fuel pipe 46 so as to be substantially perpendicular thereto. Fuel pipe brackets 50 are also connected to base 16 through the use of sheet metal screws 52 which travel through pipe brackets 50 and base 16. Thus, fuel pipe 46 and fuel injecting orifice coupling 44 are situated and held in position with respect to base 16 and venturi tube 30.

So as to view the burning operation within cylindrical burner body 10, base 16 has a circular window opening 54 covered with a substantially unbreakable translucent sheet 56. Translucent sheet 56 is held in position on the exterior surface of base 16 through the use of window retaining ring 58. Translucent sheet 56 is sandwiched between base 16 and window retaining ring 58 and, thereafter, window retaining ring 58 is riveted with rivets 60 onto base 16 or is connected to base 16 through other suitable connecting means.

Fuel injected through orifice 42 is ignited near venturi tube flame opening 36 through the use of electrical ignition means generally indicated as 62. Electrical ignition means 62 includes a heating element 64 held in position through the use of heating element porcelain portion 68. Porcelain portion 68 is connected to heating element mounting base 66 with porcelain portion mounting screw 70. Heating element mounting base 66 is connected to venturi tube 30 by welding or other suitable means. Heating element 64 is electrically connected to heating element electrical power wires 72 which lead and are connected to electrical slip connector 76. Electrical slip connector 76 is mounted to base 16 in a known and customary manner. Electrical power wires 72 are surrounded by a protective sheath 74 so as to protect electric power wires 72 from heat generated within cylindrical fuel burner body 10.

Base 16 is connected to cylindrical burner body 10. Base 16 has integral therewith a cylindrical lip portion 88 which extends substantially perpendicular to base 16. Base cylindrical lip portion 88 has an inner diameter greater than than the outer diameter of cylindrical burner body 10 so that base cylindrical lip portion 88 can slip over cylindrical burner body 10 as shown in FIG. 3. Thereafter, base mounting bolts or screws 90 are received through base mounting holes 92 and through holes in cylindrical body 10, (now shown), so that base 16 and all attachments thereto can be held in position with respect to cylindrical burner body 10. Thus, servicing of parts within cylindrical burner body 10, such as electrical ignition means 62, is accomplished by removing base 16 by first removing base mounting bolts 90.

Figure 8:
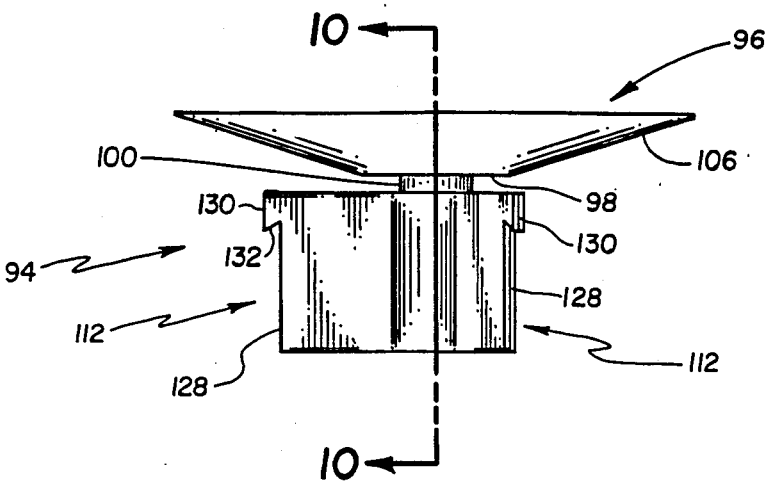
FIG. 8 is a side elevational view of the flame spreader apparatus of the fuel burner shown in FIG. 1.
Figure 9:
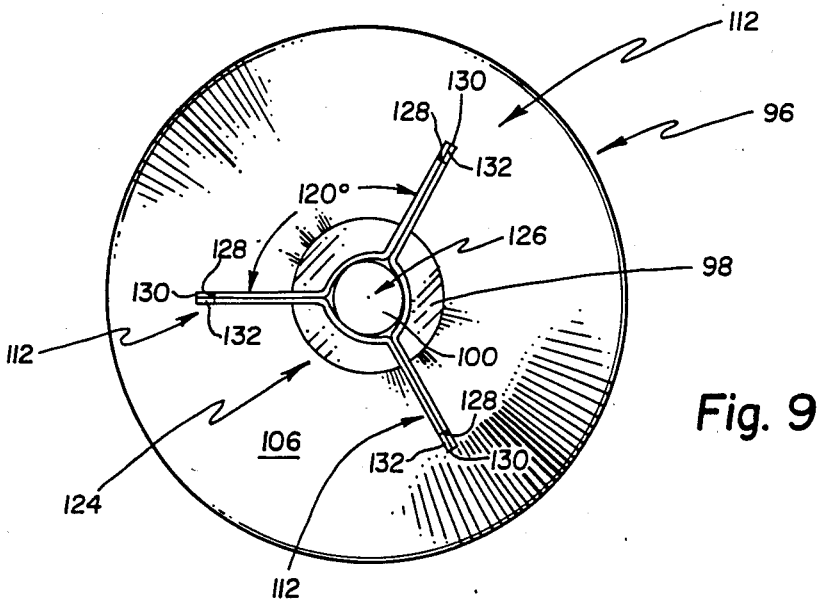
FIG. 9 is a bottom plan view of the flame spreader apparatus shown in FIG. 8.
Figure 10:
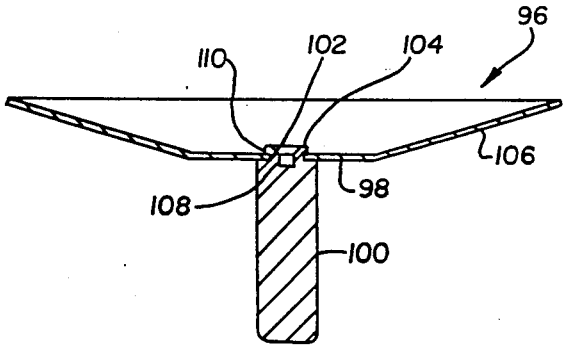
FIG. 10 is a cross-sectional side view of the flame spreader and stem taken along line 10—10 of FIG. 8.

Opposite the end of base 16, mounted on circular peripheral edge 22, there is provided a flame spreader apparatus 94 for distributing the flames, combustion gases and any unburned fuel from within cylindrical burner body 10. As shown in FIGS. 8-10, flame spreader apparatus 94 includes flame spreader 96 having a generally frusto-conical shape. Flame spreader 96 is made of sheet metal or other suitable material and has flat disk portion 98 and a conical portion 106. Flat disk portion 98 is situated at the smaller end of conical portion 106. Flat disk portion 98 has a hole 102 located substantially at its midpoint.

Flame spreader apparatus 94 also includes stem 100 which is substantially rod-shaped with a protruding portion 104. Stem protruding portion 104 has a cylindrical bore 108. In connecting together stem 100 and flame spreader 96, stem protruding portion 104 is inserted into flat disk portion hole 102 and the outer periphery 110 of protruding portion 104 is forced radially outwardly by forcing a conical tool into cylindrical bore 108. Thus, an interference connection is made between stem 100 and flame spreader 106. The resulting connection is shown in FIG. 10 whereat bore 108 has been deformed conically by a conical tool (not shown). It should be noted that other suitable means of connecting stem 100 and flame spreader 96 are available such as by welding.

Figure 11:
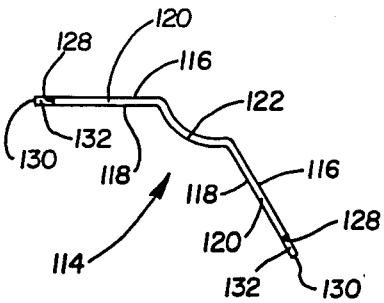
FIG. 11 is a bottom plan view of an angular flat member utilized in making the leg portions of the flame spreader apparatus shown in FIG. 9.

Flame spreader 96 and stem 100 are held in position in front of burner flame opening 20 by a plurality of leg portions generally designated as 112. Leg portions 112 are situated substantially 120 degrees apart from each other as shown in FIG. 9. Leg portions 112 are equal in length and are made up of three angular flat members 114. As shown in FIG. 11, each angular flat member 114 has two walls 120 each of which have an inner angle side 116 and an outer angle side 118. The two walls 120 of each of angular flat member 114 are connected together with a semi-cylindrical portion 122. Thus, in forming leg portions 112, three angular flat members 114 are joined as shown in FIG. 9 so that an inner angle side 116 of each angular flat members 114 faces an inner angle side 116 of another angular flat member 114. In this fashion, a triad is formed with equal length leg portions 112 having a midpoint generally designated as 124. Further, semi-cylindrical portions 112, when angular flat members 114 are connected together as shown in FIG. 9, form a cylindrical opening generally designated as 126. As shown in FIGS. 8 and 9, stem 100 is received within cylindrical opening 126 and is held therein by an interference fit. It should be noted that stem 100 can be welded to angular flat members 114 so as to be held in position within cylindrical opening 126.

Each leg portion 112 has an outer edge 128 and a leg extending portion 130. Thus, a notch 132 is formed between each outer edge 128 and leg extending portion 130.

Notches 132 are useful in mounting flame spreader apparatus 94 upon cylindrical burner body 10. More specifically, as shown in FIG. 3, notches 132 are adapted to receive a portion of circular peripheral edge 22. Each leg extending portion 130 is thereafter welded to frusto-conical portion 18 so as to hold in position, in front of burner flame opening 20, flame spreader apparatus 94. It should be noted that frusto-conical portion 18 is connected to cylindrical burner body 10 by welding or other suitable means as shown in FIG. 3.

In one embodiment, as shown in FIG. 1, combustion air is drawn through air inlet 24 through the use of blower 134 located in flue line 136. Thus, in this embodiment, combustion air is pulled into cylindrical burner body 10 as indicated by arrow A and is used in combustion of the fuel injected within venturi tube 30. Thereafter, the flames along with the combustion gases and any unburned fuel are pulled through flame opening 20 against flame spreader 96. Flame spreader 96, thus, distributes the combustion gases and the flames so as to more evenly heat heat exchanger 14. Thereafter, the combustion gases are pulled through flue line 136 and are expended into the atmosphere.

In a second embodiment as shown in FIG. 2, blower 134 is connected to air inlet 24 so that combustion air may be blown or pushed into cylindrical burner body 10. Combustion gases and flames thereafter exit cylindrical burner body 10 as described above with respect to the first embodiment shown in FIG. 1.

It should be noted that in the first embodiment shown in FIG. 1, air drawn into cylindrical burner body 10 is not as turbulent as that of the second embodiment shown in FIG. 2. This is because air is pulled into burner 12 rather than being pushed by a blower located substantially near the cylindrical burner body 10. Thus, in the first embodiment, because turbulent air is pulled into cylindrical burner body 10, the fuel burning operation is quieter than the embodiment show in FIG. 2. Further, by providing less turbulent air, fuel injected into venturi tube 30 is more efficiently burned and, thus, a larger amount of heat is provided per unit of fuel. It should further be noted that less turbulent air can be provided in the embodiment shown in FIG. 2 by locating blower 134 substantially forward of air inlet 24 so that the air pushed by blower 134 has adequate time to smoothen out and become less turbulent prior to entering cylindrical burner body 10.

So as to more smoothly introduce fuel into venturi tube 30 during start up, a two-stage gas/fuel valve or a slow opening gas/fuel valve 140 is provided. Valve 140 is connected to and communications with fuel pipe 46 and fuel supply line 142. During start up, valve 140 gradually introduces the gaseous fuel from supply line 142 to fuel pipe 46 and venturi tube 30.

In operation, when heat is required from the heat exchanger, a signal (not shown) is sent to valve 140 which then gradually opens and allows fuel to flow into fuel pipe 46 and venturi tube 30. Because the fuel is introduced gradually into burner 12, the fuel is generally given sufficient time to combust and, thus, cause start up to occur more quickly because the combustion chamber becomes heated more quickly. Further, generally less uncombusted fuel is expended through the flue line and the burner efficiency is, thus, increased.

Flame spreader apparatus 94 is not only inexpensive and substantially easy to manufacture but also, in operation, is capable of retaining its position. That is, even during operation, leg portions 112 are substantially evenly heated and, thus, expand in an equal amount and direction. Accordingly, cylindrical opening 126 and stem 100 remain concentric with cylindrical burner body 10 and flame spreader 96 also remains substantially parallel to burner flame opening 20. In this fashion, the flames, combustion gases and fuel particles which have not yet combusted are evenly deflected and distributed as they enter heat exchanger 14. Heat exchanger 14 is thus more evenly heated and the overall heat transfer from the heat exchanger 14 to the overall heating system is increased, thereby also increasing the overall efficiency of the heating system. Further, by evenly deflecting and distributing the fuel particles which have not combusted, streams of unspent fuel are avoided and the unspent fuel is caused to more readily combine with combustion air and, thus, combust. In this fashion, more of the fuel is caused to combust and produce heat, thereby making the overall heating system more efficient.

While the invention has been described as having specific embodiments, it will be understood that it is capable of further modification. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A flame spreader apparatus for use with a burner including an opening wherethrough flames from within the burner exit, said flame spreader apparatus comprising:

a flame spreader;

a stem portion connected to said flame spreader;

a plurality of leg portions, each leg portion adapted for connecting to said burner at one end thereof and meeting with at least one other respective leg portion at the other end thereof; and wherein said stem portion is mounted to said meeting of said leg portions whereby said flame spreader can distribute flames coming out of the burner.

2. The flame spreader apparatus of claim 1 wherein said plurality of leg portions consist of a total of three substantially equal length leg portions, all three equal length leg portions meeting together at one end thereof and each of said equal length leg portions situated substantially 120° from the respective other two equal length leg portions, said stem portion mounted to said meeting of said three equal length leg portions.

3. The flame spreader apparatus of claim 2 wherein said three equal length leg portions comprise three angular flat members, each of said angular flat members having two wall portions connected together substantially 120° apart, said walls having an inner angle side and an outer angle side, each of said outer angle sides of each angular flat member connected to an outer angle side of another angular flat member so that each of said leg portions is made up of two wall portions connected together with their outer angle sides facing each other.

4. The flame spreader apparatus of claim 3 wherein each of said angular flat members include a semi-cylindrical portion between each of said wall portions, said semi-cylindrical portion connecting together said wall portions of each angular flat member, and said semi-cylindrical portions together forming a cylindrical opening wherein said stem is received.

5. The flame spreader apparatus of claim 3 wherein the burner opening includes a circular peripheral edge and said equal length leg portions include an outer edge substantially opposite said meeting of said three equal length leg portions, said outer edges each having a notch therein for receiving a portion of the circular peripheral edge of the burner opening.

6. The flame spreader apparatus of claim 1 wherein said flame spreader is substantially frusto-conical shaped having a flat disk portion at the smaller end thereof, said stem connected to substantially the midpoint of said flat disk portion and generally perpendicular thereto, said stem adapted to be mounted to said leg portions so as to be substantially perpendicular to the burner opening, thereby making said flat disk portion substantially parallel to the burner opening.

7. The flame spreader apparatus of claim 6 wherein said flat disk portion has a hole therein substantially at its midpoint, said stem having a protruding portion received within said hole of said flat disk portion, and said connection between said stem and said flame spreader being substantially an interference fit between said protruding cylindrical portion and said hole of said disk portion.

8. The flame spreader apparatus of claim 7 wherein said stem is substantially rod-shaped and a cylindrical portion having an opening is connected to said midpoint of said leg portions, said stem mounted to said leg portions by being received within said cylindrical portion through said opening.

9. A fuel burner apparatus comprising:

a heat exchanger having a circular inlet and an outlet;

a fuel burner having a cylindrical burner body with an air inlet and a flame opening;

a ring member receiving therethrough and connected to said cylindrical burner body, said burner body also received within said heat exchanger circular inlet with said flame opening in said heat exchanger and said air inlet outside of said heat exchanger, said ring member connected to said heat exchanger thereby connecting said fuel burner to said heat exchanger;

a flame spreader apparatus including a flame spreader, a stem portion connected to said flame spreader, a plurality of leg portions connected to said burner body at one end thereof and meeting with at least one other respective leg portion at the other end thereof, and wherein said stem portion is mounted to said meeting of said leg portions whereby said flame spreader can distribute flames coming out of the burner flame opening; and draft inducing means connected to said fuel burner apparatus for forcing air through said fuel burner air inlet, through said fuel burner and heat exchanger and out through said heat exchanger outlet.

10. The fuel burner apparatus of claim 9 wherein said draft inducing means includes a blower connected to said fuel burner air inlet whereby said blower pushes air through said burner air inlet through said fuel burner and heat exchanger and out through said heat exchanger outlet.

11. The fuel burner apparatus of claim 9 wherein said draft inducing means includes a blower connected to said heat exchanger outlet for drawing air through said fuel burner air inlet through said fuel burner and heat exchanger and out through said heat exchanger outlet.

12. The fuel burner apparatus of claim 9 further comprising:

a fuel pipe communicating at one end thereof with said burner body;

a fuel valve connected to and communicating with the other end of said fuel pipe and adapted for connecting to a fuel supply, said fuel valve gradually introducing fuel into said fuel pipe.

* * * * *